United States Patent [19]

Mutchler

[11] Patent Number: 4,788,963

[45] Date of Patent: Dec. 6, 1988

[54] FUEL SUPPLY SYSTEM FOR HEATER

[75] Inventor: Paul A. Mutchler, University City, Mo.

[73] Assignee: Engineered Air Systems, Inc., St. Louis, Mo.

[21] Appl. No.: 123,422

[22] Filed: Nov. 20, 1987

Related U.S. Application Data

[63] Continuation of Ser. No. 887,228, Jul. 21, 1986, abandoned.

[51] Int. Cl.[4] ..... F24H 3/00

[52] U.S. Cl. ..... 126/116 A; 431/117; 431/75; 123/575

[58] Field of Search ..... 126/116 A; 431/62, 63, 431/31, 75, 117; 222/129, 113, 318, 282; 123/575

[56] References Cited

U.S. PATENT DOCUMENTS

| | | | |
|---|---|---|---|
| 2,416,546 | 2/1947 | Resek | 431/117 X |
| 2,979,124 | 4/1961 | Kirk | 431/63 |
| 3,017,112 | 1/1962 | Amundson | 126/116 A |
| 3,051,227 | 8/1962 | Robson | 126/116 A |
| 3,982,516 | 9/1976 | Abernathy | 123/575 X |
| 4,403,589 | 9/1983 | Bowen et al. | 123/575 X |
| 4,460,328 | 7/1984 | Niederholtmeyer | 431/11 |
| 4,502,453 | 3/1985 | Kabasin et al. | 123/575 |

*Primary Examiner*—Randall L. Green
*Attorney, Agent, or Firm*—Ralph B. Brick

[57] ABSTRACT

A fuel supply system for a fuel spray combustor nozzle of a portable heater including a pump connected to the fuel spray combustor nozzle on the high pressure side thereof and alternatively connectable on the low pressure side to an on-board fuel chamber storage means or to an off-board storage supply through an actuable valve and solenoid system connected by fluid piping, valves and fittings extending between the on-board nozzle, pump, and storage chambers and toward off-board supply.

13 Claims, 1 Drawing Sheet

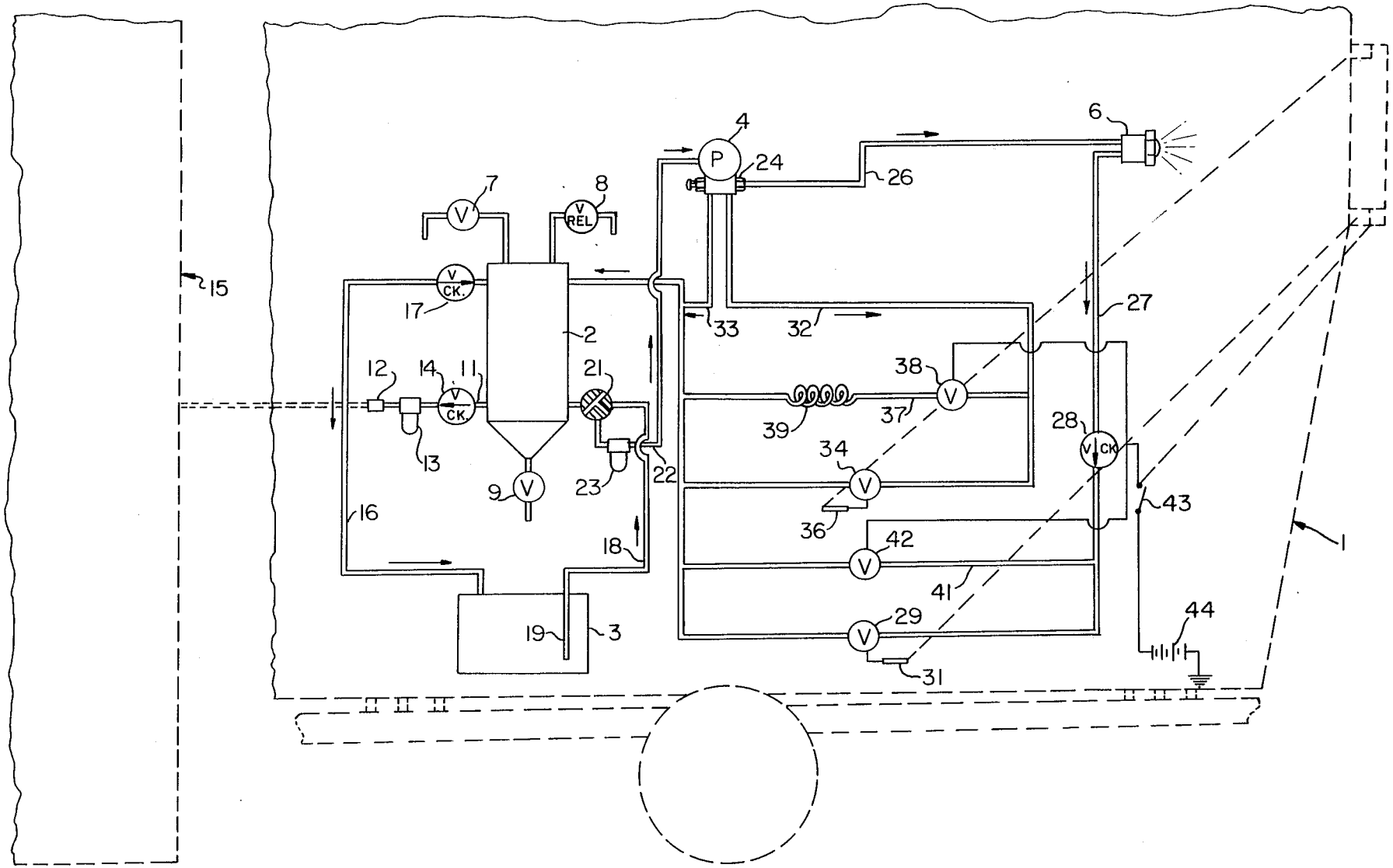
1
2
3
4
6
7
8
9
11
12
13
14
15
16
17
18
19
21
22
23
24
26
27
28
29
31
32
33
34
36
37
38
39
41
42
43
44
P
V
CK.
REL

FUEL SUPPLY SYSTEM FOR HEATER

BACKGROUND OF THE INVENTION

This is a continuation of application Ser. No. 887,228 filed on July 21, 1986 now abandoned.

The present invention relates to a fuel supply system and more particularly to an improved fuel supply system for a heater of the portable type which can be used for purposes which require continuous delivery of heat over extended periods of time.

Portable heaters for heating equipment and personnel have been utilized for many years for both commercial and military purposes, such heaters being adapted for ready movement over sometimes difficult terrain and for use in varying climates to heat living quarters, airplane hangars, airplane engines and fuselages, construction sites, mess halls and the like. These past portable heaters have carried the required fuel supply along with the carriage structure for the mobile heater thus being limited in fuel volume and operational running time, often necessitating frequent trips to a central fuel depot for refueling purposes and concomitant interruptions in heat delivery. Although it has been long known to use fuel systems with multiple on-board tanks to meet extra fuel demands, such as is disclosed in U.S. patents: No. 1,325,180, issued to F. Weinberg on Dec. 16, 1919; No. 1,382,407, issued to C. G. Branigan on June 21, 1982; No. 4,039,637, issued to Albert Grosseau on Aug. 2, 1977; and, No. 4,288,006, issued to Harold C. Oban etal on Sept. 8, 1981, nowhere has the need for a fuel system, as taught by the present invention been recognized, yet alone resolved in the novel manner as set forth herein.

The present invention recognizing the limitations of past portable heaters provides a fuel supply system for portable heaters which can be utilized for both limited purposes and conditions and which can be readily adapted to operate over long periods of time in situations where large fuel storage supplies are physically available without compromise to the structure used for the more limited occasions but rather adapting to such structure to facilitate continuous operation during the transition. The present invention provides structure which accomplishes these purposes in a straightforward and economical fashion with a minimum of equipment and a minimum of time.

Various other features of the present invention will become obvious to one skilled in the art upon reading the disclosure set forth herein. Although not to be considered in any manner as limited thereto, the unique features of the inventive fuel supply system disclosed herein have particular utility with diesel type fuel which is the present day primary fuel in the military. However, it is to be understood that other type fluid fuel such as gasoline can also be employed with the fuel system of the present invention.

SUMMARY OF THE INVENTION

More particularly, the present invention provides an improved fuel supply system for a fuel spray combustor nozzle of a portable heater comprising: a fuel pump having a low and high pressure side mounted on-board the portable heater, the pump being connected on the high pressure side thereof to the fuel spray combustor nozzle; fuel chamber storage means mounted on-board the portable heater, the fuel chamber storage means being connected to the low pressure side of the fuel pump to allow for on-board deliverance of fuel from the fuel chamber means to the fuel pump; and, external fuel supply means connected to the fuel pump to allow fuel to be delivered from an off-board fuel storage source to the portable heater through the pump to the fuel spray combustor nozzle. In addition, the present invention provides a unique main and auxiliary on-board tank arrangement through which the aforedescribed fuel system works.

It is to be understood that various changes can be made in one or more of the several parts of the inventive fuel system described herein without departing from the scope or spirit of the present invention.

BRIEF DESCRIPTION OF THE DRAWING

Referring to the drawing, the inventive fuel supply system, all of which is mounted on-board a portable heater carriage, is disclosed with the portable heater and external fuel supply being partially shown in phantom and with the location of heat sensors being shown by dotted lines schematically.

DETAILED DESCRIPTION OF THE DRAWING

As can be seen in the drawing, the inventive fuel supply system which is mounted on a suitable portable heater details of which are not disclosed but which is schematically represented in phantom by reference numeral 1, includes a portable fuel storage chamber means in the form of an auxiliary fuel tank 2 having a capacity of approximately 2 gallons positioned above a main tank 3 having a capacity in the range of approximately 10–20 gallons. These fuel tanks are connected to each other and to fuel pump 4 and fuel spray nozzle 6 through suitable flow conduits described hereinafter, it being noted that only the fuel spray nozzle 6 for the combustor of the portable heater is disclosed herein. It is to be understood that various types of portable heaters and fuels can be employed with the inventive fuel supply system described herein and advantageously the heater would be of a diesel fuel burning type having an output rating of 250,000 BTUH at 0° F. at sea level to 500 feet elevation, capable of delivering 60 pounds of heated air per minute against a one-inch water gauge back pressure and operational at ambient temperatures from −50° F. to +65° F. at sea level to 10,000 feet elevation with a turn down ratio of 2 to 1.

Auxiliary tank 2 is provided at its upper portion with a manual vent valve assembly 7 and a pressure relief valve assembly 8. At its bottom portion, a suitable drain valve assembly 9 is connected thereto for draining water and sediment and, in accordance with the present invention, one lower side of tank 2 has a conduit 11 connected thereto with a quick disconnect valved fitting 12 positioned at the free end of the conduit 11. Positioned within conduit 11 downstream of fitting 12 is a filter 13 followed by a one-way check valve 14 between filter 13 and tank 2 to permit fluid flow to tank 2 and inhibit flow therefrom, valve 14 advantageously having a preselected cracking pressure in the range of 1–2 psig. As will be described more fully hereinafter, quick disconnect fitting 12 can be connected to an "off-board" fuel storage supply as partially indicated by phantom lines and by reference numeral 15 to permit fuel to be supplied continuously through auxiliary tank 2 to burner spray nozzle 6 continuously over extended periods of time. It will be obvious that one-way check valve 14 allows fuel only to be delivered to tank 2 and not to be removed therefrom through conduit 11.

To prevent auxiliary tank 2 from overfilling, an overflow conduit 16 leads from the upper portion of tank 2 to main tank 3. A suitable one-way check valve 17 is positioned in conduit 16 to permit fluid flow from tank 2 and inhibit flow thereto. Valve 17 also has a preselected cracking pressure advantageously in the range of approximately 1–2 psig.

To supply fuel from main tank 3 to auxiliary tank 2, a tank connecting conduit 18 extends from the lower portion of auxiliary tank 2 to main tank 3, conduit 18 being provided with a dip tube 19 extending into main tank 3. A three-way valve 21 is positioned in conduit 18 to allow fuel to pass through two of its ports from main tank 3 through the filter 23, conduit 22, through the pump 4 and conduits 32 and 27 to auxiliary tank 2 when the valve has been so properly positioned. The other position of the three-way valve 21 connects auxiliary tank 2 to conduit 22 to the fuel supply inlet of pump 4, the fluid filter 23 being positioned in conduit 22 to filter the fuel as it passes from the tank 2 to pump 4.

One port of pump 4, denominated the nozzle port 24 is connected to spray nozzle 6 through conduit 26. A fuel bleed off conduit 27 extends from spray nozzle 6 to the upper part of auxiliary tank 2. Conduit 27 is provided with a one-way check valve 28 therein to allow flow from nozzle 6, valve 28 advantageously having a preselected cracking pressure of approximately 30 psig. Also positioned in conduit 27 downstream of check valve 28 is a temperature selector valve 29, the selector valve 29 having a heat sensor 31 which advantageously is positioned in the hot air outlet of the portable heater as indicated by dotted line in the drawing.

Connected to the fuel bleed off conduit 27 are two bypass conduits leading from ports of pump 4, namely primary bypass conduit 32 and secondary bypass conduit 33. Primary bypass conduit 32 includes a normally open, manually operable firing valve 34 having a valve sensor or limit control 36 associated with the heater outlet, as indicated by the dotted lines in the drawing, connected thereto which functions to open valve 34 in the event of excessive temperatures. In parallel with valve 34 in series in parallel conduit 37 is a normally open solenoid valve 38 and capillary limiting tube 39, advantageously having a fuel limitation pressure of approximately 100 psig. In like fashion in parallel with aforementioned temperature selector valve 29 in fuel bleed off conduit 27 is parallel conduit 41 in which is located a similarly normally open solenoid valve 42. Both solenoid valve 38 which is parallel to firing valve 34 and solenoid valve 42 which is parallel to temperature selector valve 29 are electrically connected to a normally open temperature switch 43 located in the heated air stream. Advantageously, switch 43 which is powered by battery 44 closes when the heated air temperature rises to a preselected point in the range of approximately 120°–130° F. to thus close normally open solenoid valves 38 and 42 in the circuit of switch 43.

In a typical operation of the apparatus described, assuming the on-board main tank 3 has been properly filled and three-way valve 21 properly set so that one of the three ports of valve 21 communicates with main on-board tank 3 through conduit 18, a second of the ports communicates with pump 4 through conduit 22 and the remaining port is isolated, fuel pump 4 is started to initiate the purge mode. With the initial running of pump 4, a vacuum is created at the pump inlet, causing fuel to rise from main tank 3 in conduit 18 of the piping system with fuel passing through the three-way valve 21, filter 23 along conduit 22 to pump 4. Pump 4 pressurizes the fuel and any air in the downstream fuel lines. Fuel is first discharged through primary bypass conduit 32 with no fuel passing to spray nozzle 4 or through secondary bypass conduit 33. Continuing in the purge mode through primary bypass conduit 32, fuel flows through normally open solenoid valve 38 and normally open firing valve 34 through bleed-off conduit 27 to the upper portion of auxiliary tank 2, tank 2 being a closed chamber except for one-way check valve 17, valve 17 having a 1 to 2 psig cracking pressure to discharge to on-board main tank 3. In the purge mode, pump 4 fills auxiliary fuel tank 2 (in approximately 3 minutes), the fuel forcing the air out of auxiliary tank 2 through check valve 17 into main tank 3. Once the pump 4 has been primed and operated in the purge mode for the desired period of time to fill auxiliary tank 2, the heater is ready for firing. The firing valve 34 which is normally open is manually closed to end the purge mode through primary bypass conduit 32 and to cause fuel pump 4 to move fuel through conduit 26 under pressure to spray nozzle 6 with excess fuel passing through secondary bypass conduit 33 to auxiliary tank 2 through return line 27. The fuel in spray nozzle 6 is introduced into the heater combustor (not shown) and ignited at approximately 50% of fuel input to allow time for temperature sensor 43 to warm to meet the heating requirements, it being noted that the heater is automatically started on low fire by controlling both the supply pressure to spray nozzle 6 and the return line or fuel bleed off conduit 27 pressure from spray nozzle 6. The fuel pump supply pressure to spray nozzle 6 is reduced, advantageously from 150 psig pump set pressure to a range of approximately 90 to 105 psig by means of bleed off line 27 and the normally open solenoid valve 38, capillary limiting tube 39 in the primary bypass conduit 32 and the normally open solenoid valve 42 in the conduit 41 parallel to bleed off conduit 27. In this regard it is to be noted that check valve 28 has just enough restriction, namely 30 psig cracking pressure to provide a stable low fire start. It is further to be noted that the fuel flowing through bleed off conduit 27 is returned to main tank 3 by way of auxiliary tank 2.

As combustion takes place, the heater starts to heat the ventilating air and when the heated air stream reaches a preselected level, advantageously in the range of 120°–130° F., the normally open temperature switch 43 located in the heated air stream closes to close normally open solenoid valves 38 and 42, in the primary bypass line 32 and in the line 41 parallel to bleed 27 respectively. When these valves are closed, full pressure is placed on spray nozzle 6, advantageously 150 psig. The temperature selector valve 29 in bleed line 27 responsive to temperature selector sensor 31 then controls the return flow of fuel through bleed line 27 thereby automatically regulating heater output in accordance with temperature sensor 31 in the heated air outlet of the portable heater.

To operate the heater from an external source of fuel supply —or example, a fuel storage depot—with or without the heater in operation, the fuel supply can be switched from the aforedescribed on-board fuel supply to the off-board storage supply and back again, as desired, by manually selecting the desired fuel source with a 90° (degree) turn of three-way valve 21 attached to the lower portion of auxiliary tank 28. Before doing so, it should be ascertained that there is no water present in tank 2 by opening drain valve 9 at the bottom of tank 2 to check a small sample of the fuel therein. It also should be ascertained that tank 2 is full by pressing down on the manual vent valve 7 at the top of tank 2 checking for flow therefrom. An external conduit (not shown) leading from the off-board storage source can then be connected to quick disconnect valved fitting 12 upstream of filter 13 in sole conduit 11. It is to be understood that fuel can be drawn from auxiliary tank 2 while the external conduit is purged. It is to be noted that when the fuel supply to pump 4 comes from an external source, the fuel level in auxiliary tank 2 falls to an equilibrium condition with the fuel level about three fourths of the tank height. A negative pressure develops within the tank 2, this negative pressure serving to open the lower check valve 14 in conduit 11 to allow fuel from an external source to flow into auxiliary tank 2 and to close upper check valve 17 to prevent air leakage through conduit 16 to the main tank 3, the negative pressure within auxiliary tank 2 further serving to overcome fuel lift height difference which might exist between the external fuel level and the fuel level in auxiliary tank 2. It is to be understood that, simply by adjusting three-way valve 21, the fuel supply to spray nozzle 6 can be changed from "off-board" to "on-board" and back again, if so desired.

The invention claimed is:

1. An improved fuel supply system for a fuel spray combustor nozzle of a portable heater comprising:

a fuel pump having a low and high pressure side mounted on-board said portable heater, said pump being connected on said high pressure side thereof to said fuel spray combustor nozzle;

fuel chamber supply means mounted on-board said portable heater including a fuel storage main chamber and a fuel storage auxiliary chamber connected thereto, said fuel chamber supply means being connected to said low pressure side of said fuel pump to allow for on-board deliverance of fuel from said fuel chamber supply means mounted on board said portable heater to said fuel pump;

separate external off-board fuel supply means communicating with said fuel pump through said auxiliary chamber to allow fuel to be readily delivered from an off-board fuel storage source to said portable heater through said auxiliary chamber and to said pump to said fuel spray combustor nozzle, said auxiliary chamber providing through a vacuum created therein by spent fuel a negative pressure to said external offboard fuel supply; and, valve means to selectively control introduction of fuel to said pump from either said main chamber independently from said auxiliary chamber or from said auxiliary chamber independently from said main chamber on said on-board fuel chamber supply means or from said separate external fuel supply means through said auxiliary chamber independently from said main chamber.

2. The fuel system of claim 1, and a quick disconnect valved means disposed between said external off-board fuel supply means and said fuel pump to facilitate connection from said off-board fuel supply means.

3. The fuel system of claim 1, said fuel system including on-board purge means to purge said system through said pump in bypass relation to said fuel spray combustor nozzle prior to introduction of fuel by said pump to said fuel spray combustor nozzle.

4. The fuel system of claim 1, said off-board fuel supply means comprising only a single conduit.

5. The fuel system of claim 1, said fuel system including control means to deliver fuel to said fuel spray combustor nozzle at a variable fuel rate in accordance with a preselected temperature of said portable heater.

6. The fuel system of claim 1, said fuel system including control means to limit the amount of fuel delivered to said fuel spray combustor nozzle in accordance with said portable heater output temperature.

7. The fuel system of claim 1, said fuel system including means to visually ascertain the status of said fuel supply system before said valve means is moved from on-board to off-board fuel supply.

8. The fuel system of claim 1,; and control means wherein said pump serves to maintain a negative pressure in said auxiliary chamber of said on-board fuel chamber means to enhance fuel delivery from said external fuel supply means during said fuel pump operation.

9. The fuel system of claim 1, said fuel system including on-board purge means to purge said system prior to introduction of fuel to said fuel nozzle, said purge means comprising a fuel bypass line extending between said fuel pump and said main chamber of said fuel chamber means and return to said auxiliary chamber in bypass relation to said fuel nozzle and having fuel flow control means disposed therein to allow fuel to bypass said nozzle and return to said auxiliary chamber until said fuel lines have been purged and said auxiliary chamber means has been primed for fuel delivery operation.

10. The fuel system of claim 1, said fuel system including control means to deliver fuel to said fuel spray combustor nozzle at a variable fuel rate in accordance with preselected temperature of said portable heater, comprising a firing valve manually operable to cause a limited amount of fuel to flow under pressure to said nozzle, a temperature sensor within said heater and a temperature responsive valve responsive to a preselected temperature sensed by said sensor to cause increased amounts of fuel to flow under increased pressure to said nozzle.

11. The fuel system of claim 1, said fuel system including control means to limit the amount of fuel delivered to said fuel spray combustor nozzle in accordance with a preselected temperature of said portable heater output, comprising:

a return conduit extending between said fuel nozzle and said fuel chamber means;

a temperature sensor positioned at said portable heater outlet; and, a temperature responsive valve in said return conduit responsive to a preselected temperature sensed by said sensor to open and cause a certain amount of fuel to said nozzle to return to said fuel chamber means.

12. The fuel system of claim 1, and control means to maintain a negative pressure in said auxiliary chamber of said on-board fuel chamber means to enhance fuel delivery from said external fuel supply means to said auxiliary chamber connected thereto and to said pump during said fuel pump operation including a check valve between said external fuel supply means and said auxiliary chamber of said on-board fuel chamber means to allow fuel to pass thereto and a check valve above said auxiliary chamber of said on-board fuel chamber to stabilize said negative pressure in said auxiliary fuel chamber.

13. An improved fuel supply system for a fuel spray combustor nozzle of a portable heater comprising:

a fuel pump having a low and high pressure side mounted on-board said portable heater, said pump being connected on said high pressure side thereof to said fuel spray combustor nozzle;

a large fuel storage main chamber and a small fuel storage auxiliary chamber connected thereto, both of said chambers being mounted on-board said portable heater and connected to said low pressure side of said fuel pump valve means to selectively control fluid flow to said pump independently from either said main or auxiliary fuel storage chamber;

external off-board fuel supply means including a quick disconnect valved member connected to said auxiliary chamber to allow fuel to be delivered readily through a single conduit from an off-board fuel storage source through said auxiliary chamber and said pump to said nozzle independently of said main chamber, said auxiliary chamber providing through the vacuum created by spent fuel a negative pressure to said external off-board fuel supply means;

purge means to purge said system prior to introduction of fuel to said combustor nozzle;

a first control means to deliver fuel to said combustor nozzle at a variable fuel rate in accordance with a preselected temperature of said portable heater;

a second control means to limit the amount of fuel delivered to said nozzle in accordance with said heater output temperature; and, a third control means to maintain a negative pressure in said auxiliary chamber of said on-board fuel chamber means to enhance fuel delivery from said external fuel supply means during said fuel pump operation.

* * * * *

UNITED STATES PATENT AND TRADEMARK OFFICE

CERTIFICATE OF CORRECTION

PATENT NO. : 4,788,963

DATED : 12-6-88

INVENTOR(S) : Paul A. Mutchler

It is certified that error appears in the above—identified patent and that said Letters Patent is hereby corrected as shown below:

Column 4, line 66, after "tank" delete "28" and insert --- 2 so that one of the three ports of valve 21 connects directly to tank 2, a second port connects through conduit 22 to pump 4 and the remaining third port is isolated. ---

Signed and Sealed this

Twenty-fifth Day of April, 1989

*Attest:*

DONALD J. QUIGG

*Attesting Officer*

*Commissioner of Patents and Trademarks*